US008241828B2

(12) United States Patent
Bennett et al.

(10) Patent No.: US 8,241,828 B2
(45) Date of Patent: Aug. 14, 2012

(54) METHOD OF FILTERING POROUS PARTICLES

(75) Inventors: James R. Bennett, Rochester, NY (US); Mridula Nair, Penfield, NY (US)

(73) Assignee: Eastman Kodak Company, Rochester, NY (US)

( * ) Notice: Subject to any disclaimer, the term of this patent is extended or adjusted under 35 U.S.C. 154(b) by 597 days.

(21) Appl. No.: 12/432,836

(22) Filed: Apr. 30, 2009

(65) Prior Publication Data

US 2010/0279225 A1 Nov. 4, 2010

(51) Int. Cl.
*G03G 9/08* (2006.01)

(52) U.S. Cl. ..... 430/137.16; 430/137.1

(58) Field of Classification Search ..... 430/137.1, 430/137.15, 137.16
See application file for complete search history.

(56) References Cited

U.S. PATENT DOCUMENTS

| | | | | |
|---|---|---|---|---|
| 3,923,704 | A | 12/1975 | Gunning et al. | |
| 4,339,237 | A | 7/1982 | Wang et al. | |
| 4,461,849 | A | 7/1984 | Karickhoff | |
| 4,489,174 | A | 12/1984 | Karickhoff | |
| 4,833,060 | A | 5/1989 | Nair et al. | |
| 4,965,131 | A | 10/1990 | Nair et al. | |
| 5,650,252 | A * | 7/1997 | Ng et al. | 430/137.14 |
| 6,544,705 | B2 | 4/2003 | Kim et al. | |
| 6,682,866 | B2 | 1/2004 | Sugiyama et al. | |
| 6,800,412 | B2 | 10/2004 | Sugiyama et al. | |
| 7,754,409 | B2 * | 7/2010 | Nair et al. | 430/137.14 |
| 2004/0161687 | A1 | 8/2004 | Kim et al. | |
| 2004/0180282 | A1 * | 9/2004 | Ota | 430/137.15 |
| 2005/0026064 | A1 | 2/2005 | Sugiura et al. | |
| 2008/0176157 | A1 | 7/2008 | Nair et al. | |
| 2008/0176164 | A1 | 7/2008 | Nair et al. | |

FOREIGN PATENT DOCUMENTS

| | | | |
|---|---|---|---|
| EP | 0 083 188 | | 7/1983 |
| JP | 2004053762 | * | 2/2004 |

OTHER PUBLICATIONS

Abstract of JP 2004053762, Feb. 2004.*

* cited by examiner

*Primary Examiner* — Hoa V Le
(74) *Attorney, Agent, or Firm* — Andrew J. Anderson

(57) ABSTRACT

The present invention is a method of manufacturing porous polymer particles comprising: forming a dispersion of porous polymer particles in an external aqueous phase, wherein individual porous particles each comprise a continuous polymer phase and internal pores containing an internal aqueous phase; and filtering the dispersion of porous polymer particles with a filter to remove the external aqueous phase, wherein the filtering is done while agitating the porous particles.

19 Claims, 1 Drawing Sheet

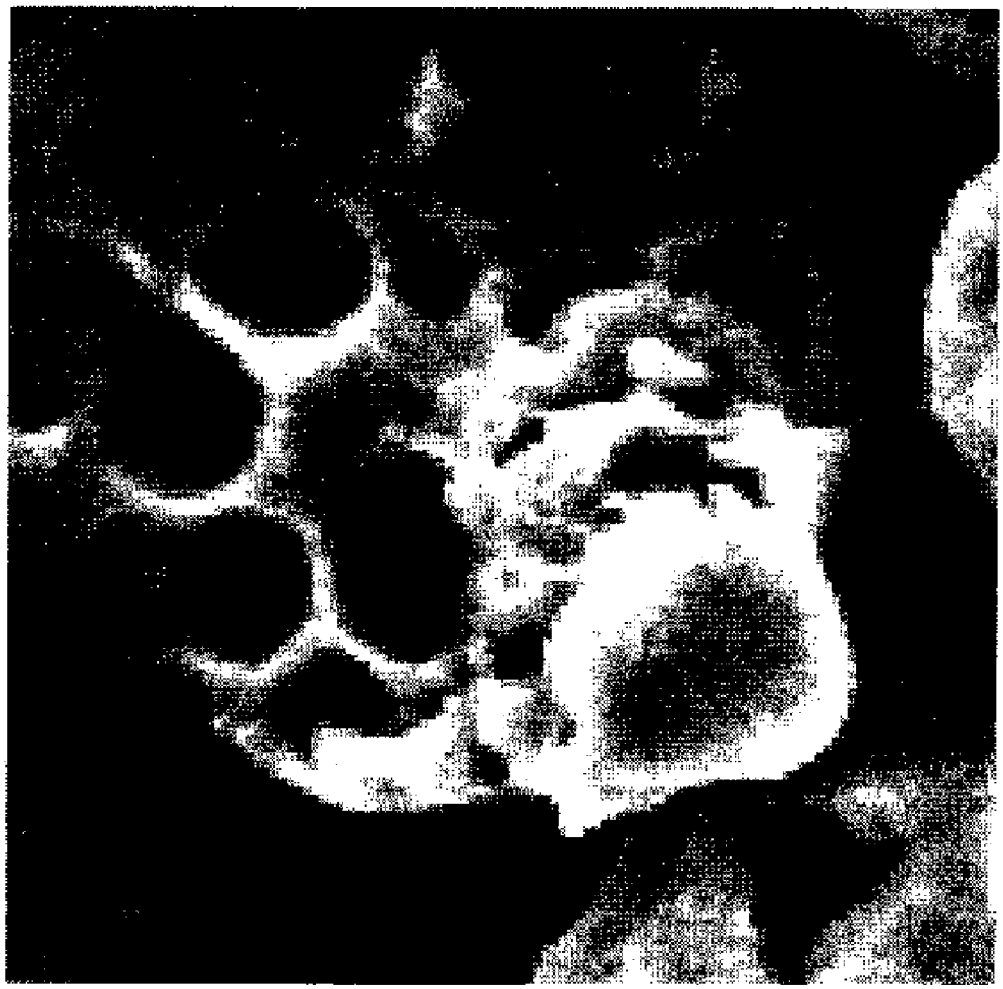

METHOD OF FILTERING POROUS PARTICLES

FIELD OF THE INVENTION

This invention relates to a method of manufacturing porous particles, wherein the porous particles are isolated from an aqueous dispersion by filtration.

BACKGROUND OF THE INVENTION

Conventional electrostatographic toner powders are made up of a binder polymer and other ingredients, such as pigment and a charge control agent, that are melt blended on a heated roll or in an extruder. The resulting solidified blend is then ground or pulverized to form a powder. Inherent in this conventional process are certain drawbacks. For example, the binder polymer must be brittle to facilitate grinding. Improved grinding can be achieved at lower molecular weight of the polymeric binder. However, low molecular weight binders have several disadvantages; they tend to form toner/developer flakes; they promote scumming of the carrier particles that are admixed with the toner powder for electrophotographic developer compositions; their low melt elasticity increases the off-set of toner to the hot fuser rollers of the electrophotographic copying apparatus, and the glass transition temperature (Tg) of the binder polymer is difficult to control. In addition, grinding of the polymer results in a wide particle size distribution. Consequently, the yield of useful toner is lower and manufacturing cost is higher. Also the toner fines accumulate in the developer station of the copying apparatus and adversely affect the developer life.

The preparation of toner polymer powders from a preformed polymer by the chemically prepared toner process such as the "evaporative limited coalescence" (ELC) offers many advantages over the conventional grinding method of producing toner particles. In this process, polymer particles having a narrow size distribution are obtained by forming a solution of a polymer in a solvent that is immiscible with water, dispersing, under suitable shear and mixing conditions, the solution so formed in an aqueous medium containing a solid colloidal stabilizer and removing the solvent. The resultant particles are then isolated, washed and dried.

In the practice of this technique, polymer particles are prepared from any type of polymer that is soluble in a solvent that is immiscible with water. Thus, the size and size distribution of the resulting particles can be predetermined and controlled by the relative quantities of the particular polymer employed, the solvent, the quantity and size of the water insoluble solid particulate suspension stabilizer, typically silica or latex, and the size to which the solvent-polymer droplets are reduced by mechanical flowing and shearing using rotor-stator type colloid mills, high pressure homogenizers, agitation etc.

Limited coalescence techniques of this type have been described in numerous patents pertaining to the preparation of electrostatic toner particles because such techniques typically result in the formation of polymer particles having a substantially uniform size distribution. Representative limited coalescence processes employed in toner preparation are described in U.S. Pat. Nos. 4,833,060, 4,965,131, 6,544,705, 6,682,866, and 6,800,412; and U.S. Patents Application No. 2004/0161687, incorporated herein by reference for all that they contain.

This technique generally includes the following steps: mixing a polymer material, a solvent and optionally additionally one or more of a colorant, a charge control agent and a wax to form an organic phase; dispersing the organic phase in an aqueous phase comprising a particulate stabilizer and homogenizing the mixture; evaporating the solvent and washing and drying the resultant product.

There is a need to reduce the amount of toner applied to a substrate in the electrophotographic process (EP). Porous toner particles in the electrophotographic process can potentially reduce the toner mass in the image area. Simplistically, a toner particle with 50% porosity should require only half as much mass to accomplish the same imaging results. Hence, toner particles having an elevated porosity will lower the cost per page and decrease the stack height of the print as well. The application of porous toners provides a practical approach to reduce the cost of the print and improve the print quality.

U.S. Pat. Nos. 3,923,704; 4,339,237; 4,461,849; 4,489,174 and EP 0083188 discuss the preparation of multiple emulsions by mixing a first emulsion in a second aqueous phase to form polymer beads. These processes produce polymer particles having a large size distribution with little control over the porosity. This is not suitable for toner particle.

US 2005/0026064 describes porous toner particles apparently obtained through a degassing reactive process. However control of particle size distribution along with the even distribution of pores throughout the particle is a problem.

US 2008/0176164 and US 2008/0176157 describe porous polymer particles that are made by a multiple emulsion process, that in one phase of the process results in formation of individual porous particles comprising a continuous polymer phase and internal pores containing an internal aqueous phase, where such individual particles are dispersed in an external aqueous phase. The particles are typically washed with water to remove stabilizers and salts from the external water phase, used in the preparation of the particles. The particles are typically isolated from the dispersion by a filtration process.

SUMMARY OF THE INVENTION

Filtration processes used to isolate porous particles comprising a continuous polymer phase and internal pores containing an internal aqueous phase from an external aqueous phase has been discovered to be generally very slow. An object of the present invention is accordingly to provide a method for increasing the filtration rates of porous polymer particle dispersions with increased porosity, containing water in the pores.

In accordance with one embodiment of the invention, a method of manufacturing porous polymer particles comprises:

forming a dispersion of porous polymer particles in an external aqueous phase, wherein individual porous particles each comprise a continuous polymer phase and internal pores containing an internal aqueous phase; and filtering the dispersion of porous particles with a filter to remove the external aqueous phase, wherein the filtering is done while agitating the porous polymer particles.

BRIEF DESCRIPTION OF THE DRAWINGS

FIG. 1 is a scanning electron microscope image of a fractured sample of the porous particles P1 obtained in Example 1.

DETAILED DESCRIPTION OF THE INVENTION

The use of porous particles in the electrophotographic process as toner particles will reduce the toner mass in the image area. For example toner particles with 50% porosity should require only half as much mass to accomplish the same imaging results. Hence, toner particles having an elevated porosity will lower the cost per page and decrease the stack height of the print as well. The porous toner technology of the present invention provides a thinner image so as to improve the image quality, reduce curl, reduce image relief, save fusing energy and feel/look more like offset printing rather than typical EP printing. In addition, colored porous particles of the present invention will narrow the cost gap between color and monochrome toners. This technology is expected to expand the EP process to broader application areas and promote more business opportunities for EP technology.

Porous polymer beads may be used in various applications, such as chromatographic columns, ion exchange and adsorption resins, as drug delivery vehicles, scaffolds for tissue engineering, in cosmetic formulations, and in the paper and paint industries. Methods for generating pores inside polymer particles are known in the field of polymer science. However, due to the specific requirements for toner binder materials, such as suitable glass transition temperatures, cross-linking density and rheology, and sensitivity to particle brittleness that comes from enhanced porosity, the preparation of porous toners is not straightforward. In the present invention, porous particles may be prepared using a multiple emulsion process, in conjunction with a suspension process, particularly, the ELC process. Such process has been found to be suitable in particular for forming porous toner particles with desirable properties.

The porous particles of the present invention include "micro," "meso," and "macro" pores which according to the International Union of Pure and Applied Chemistry are the classifications recommended for pores less than 2 nm, 2 to 50 nm, and greater than 50 nm respectively. The term porous particles will be used herein to include pores of all sizes, including open or closed pores.

The preferred process for making the porous particles employed in this invention involves basically a three-step process. The first step involves the formation of a stable water-in-oil emulsion, including a first aqueous solution of a pore stabilizing hydrocolloid dispersed finely in a continuous phase of a binder polymer dissolved in an organic solvent. This first water phase creates the pores in the particles and the pore stabilizing compound controls the pore size and number of pores in the particle, while stabilizing the pores such that the final particle is not brittle or fractured easily.

In the preferred practice of this invention, suitable pore stabilizing hydrocolloids include both naturally occurring and synthetic, water-soluble or water-swellable polymers such as, cellulose derivatives e.g., carboxymethyl cellulose (CMC) also referred to as sodium carboxymethyl cellulose, gelatin e.g., alkali-treated gelatin such as cattle bone or hide gelatin, or acid treated gelatin such as pigskin gelatin, gelatin derivatives e.g., acetylated gelatin, phthalated gelatin, and the like, substances such as proteins and protein derivatives, synthetic polymeric binders such as poly(vinyl alcohol), poly (vinyl lactams), acrylamide polymers, polyvinyl acetals, polymers of alkyl and sulfoalkyl acrylates and methacrylates, hydrolyzed polyvinyl acetates, polyamides, polyvinyl pyridine, methacrylamide copolymers, water soluble microgels, polyelectrolytes and mixtures thereof.

In order to stabilize the initial first step water-in-oil emulsion so that it can be held without ripening or coalescence, if desired, it is preferable that the hydrocolloid in the water phase have a higher osmotic pressure than that of the binder in the oil phase depending on the solubility of water in the oil. This dramatically reduces the diffusion of water into the oil phase and thus the ripening caused by migration of water between the water droplets. One can achieve a high osmotic pressure in the water phase either by increasing the concentration of the hydrocolloid or by increasing the charge on the hydrocolloid (the counter-ions of the dissociated charges on the hydrocolloid increase the osmotic pressure of the hydrocolloid). It can be advantageous to have weak base or weak acid moieties in the pore stabilizing hydrocolloid which allow for the osmotic pressure of the hydrocolloid to be controlled by changing the pH. We will call these hydrocolloids "weakly dissociating hydrocolloids." For these weakly dissociating hydrocolloids the osmotic pressure can be increased by buffering the pH to favor dissociation, or by simply adding a base (or acid) to change the pH of the water phase to favor dissociation. A preferred example of such a weakly dissociating hydrocolloid is CMC which has a pH sensitive dissociation (the carboxylate is a weak acid moiety). For CMC the osmotic pressure can be increased by buffering the pH, for example using a pH 6-8 phosphate buffer, or by simply adding a base to raise the pH of the water phase to favor dissociation (for CMC the osmotic pressure increases rapidly as the pH is increased from 4 to 8).

Other synthetic polyclectrolytes hydrocolloids such as polystyrene sulphonate (PSS) or poly(2-acrylamido-2-methylpropanesulfonate) (PAMS) or polyphosphates are also possible hydrocolloids. These hydrocolloids have strongly dissociating moieties. While the pH control of osmotic pressure which can be advantageous, as described above, is not possible due to the strong dissociation of charges for these strongly dissociating polyelectrolyte hydrocolloids, these systems will be insensitive to varying level of acid impurities. This is a potential advantage for these strongly dissociating polyclectrolyte hydrocolloids particularly when used with binder polymers that have varying levels of acid impurities such as polyesters.

The essential properties of the pore stabilizing hydrocolloids are solubility in water, no negative impact on multiple emulsification process, and no negative impact on melt rheology of the resulting particles when they are used as electrostatographic toners. The pore stabilizing compounds can be optionally cross-linked in the pore to minimize migration of the compound to the surface affecting triboelectrification of the toners. The amount of the hydrocolloid used in the first step will depend on the amount of porosity and size of pores desired and the molecular weight, and charge of the hydrocolloid chosen. A particularly preferred hydrocolloid is CMC and in an amount of from 0.5-20 weight percent of the binder polymer, preferably in an amount of from 1-10 weight percent of the binder polymer.

The first aqueous phase may additionally contain, if desired, salts to buffer the solution and to optionally control the osmotic pressure of the first aqueous phase as described earlier. For CMC the osmotic pressure can be increased by buffering using a pH 7 phosphate buffer. It may also contain additional porogen or pore forming agents such as ammonium carbonate.

As indicated above, the present invention is applicable to the preparation of polymeric particles from any type of binder polymer or binder resin that is capable of being dissolved in a solvent that is immiscible with water wherein the binder itself is substantially insoluble in water. Useful binder polymers include those derived from vinyl monomers, such as styrene monomers, and condensation monomers such as esters and mixtures thereof. As the binder polymer, known binder resins are useable. Concretely, these binder resins include homopolymers and copolymers such as polyesters, styrenes, e.g. styrene and chlorostyrene; monoolefins, e.g. ethylene, propylene, butylene, and isoprene; vinyl esters, e.g. vinyl acetate, vinyl propionate, vinyl benzoate, and vinyl butyrate; α-methylene aliphatic monocarboxylic acid esters, e.g. methyl acrylate, ethyl acrylate, butyl acrylate, dodecyl acrylate, octyl acrylate, phenyl acrylate, methyl methacrylate, ethyl methacrylate, butyl methacrylate, and dodecyl methacrylate; vinyl ethers, e.g. vinyl methyl ether, vinyl ethyl ether, and vinyl butyl ether; and vinyl ketones, e.g. vinyl methyl ketone, vinyl hexyl ketone, and vinyl isopropenyl ketone. Particularly desirable binder polymers/resins include polystyrene resin, polyester resin, styrene/alkyl acrylate copolymers, styrene/alkyl methacrylate copolymers, styrene/acrylonitrile copolymer, styrene/butadiene copolymer, styrene/maleic anhydride copolymer, polyethylene resin and polypropylene resin. They further include polyurethane resin, epoxy resin, silicone resin, polyamide resin, modified rosin, paraffins, and waxes. Also, especially useful are polyesters of aromatic or aliphatic dicarboxylic acids with one or more aliphatic diols, such as polyesters of isophthalic or terephthalic or fumaric acid with diols such as ethylene glycol, cyclohexane dimethanol and bisphenol adducts of ethylene or propylene oxides. Preferably the acid values (expressed as milligrams of potassium hydroxide per gram of resin) of the polyester resins are in the range of 2-100. The polyesters may be saturated or unsaturated. Of these resins, styrene/acryl and polyester resins are particularly preferable.

Preferably the acid values (expressed as milligrams of potassium hydroxide per gram of resin) of the polyester resins are in the range of 2-100. The polyesters may be saturated or unsaturated. Of these resins, styrene/acryl and polyester resins are particularly preferable.

In the practice of this invention, it is particularly advantageous to utilize resins having a viscosity in the range of 1 to 100 centipoise when measured as a 20 weight percent solution in ethyl acetate at 25° C.

Any suitable solvent that will dissolve the binder polymer and which is also immiscible with water may be used in the practice of this invention such as for example, chloromethane, dichloromethane, ethyl acetate, vinyl chloride, trichloromethane, carbon tetrachloride, ethylene chloride, trichloroethane, toluene, xylene, cyclohexanone, 2-nitropropane and the like. A particularly useful solvent in the practice of this invention are ethyl acetate and propyl acetate for the reason that they are both good solvents for many polymers while at the same time being sparingly soluble in water. Further, their volatility is such that they are readily removed from the discontinuous phase droplets as described below, by evaporation.

Optionally, the solvent that will dissolve the binder polymer and which is immiscible with water may be a mixture of two or more water-immiscible solvents chosen from the list given above. Optionally the solvent may comprise a mixture of one or more of the above solvents and a water-immiscible nonsolvent for the binder polymer such as heptane, cyclohexane, diethylether and the like, that is added in a proportion that is insufficient to precipitate the binder polymer prior to drying and isolation.

Various additives generally present in electrostatographic toners may be added to the binder polymer prior to dissolution in the solvent, during dissolution, or after the dissolution step itself, such as colorants, charge control agents, and release agents such as waxes and lubricants.

Colorants, a pigment or dye, suitable for use in the practice of the present invention are disclosed, for example, in U.S. Reissue Pat. 31,072 and in U.S. Pat. Nos. 4,160,644; 4,416,965; 4,414,152 and 4,229,513. As the colorants, known colorants can be used. The colorants include, for example, carbon black, Aniline Blue, Calcoil Blue, Chrome Yellow, Ultramarine Blue, Du Pont Oil Red, Quinoline Yellow, Methylene Blue Chloride, Phthalocyanine Blue, Malachite Green Oxalate, Lamp Black, Rose Bengal, C.I. Pigment Red 48:1, C.I. Pigment Red 122, C.I. Pigment Red 57:1, C.I. Pigment Yellow 97, C.I. Pigment Yellow 12, C.I. Pigment Yellow 17, C.I. Pigment Blue 15:1 and C.I. Pigment Blue 15:3. Colorants can generally be employed in the range of from about 1 to about 90 weight percent on a total toner powder weight basis, and preferably in the range of about 2 to about 20 weight percent, and most preferably from 4 to 15 weight percent in the practice of this invention. When the colorant content is 4% or more by weight, a sufficient coloring power can be obtained, and when it is 15% or less by weight, good transparency can be obtained. Mixtures of colorants can also be used. Colorants in any form such as dry powder, its aqueous or oil dispersions or wet cake can be used in the present invention. Colorant milled by any methods like media-mill or ball-mill can be used as well. The colorant may be incorporated in the oil phase or in the first aqueous phase.

The release agents preferably used herein are waxes. Concretely, the releasing agents usable herein are low-molecular weight polyolefins such as polyethylene, polypropylene and polybutene; silicone resins which can be softened by beating; fatty acid amides such as oleamide, erucamide, ricinoleamide and stearamide; vegetable waxes such as camauba wax, rice wax, candelilla wax, Japan wax and jojoba oil; animal waxes such as bees wax; mineral and petroleum waxes such as montan wax, ozocerite, ceresine, paraffin wax, microcrystalline wax and Fischer-Tropsch wax; and modified products thereof. When a wax containing a wax ester having a high polarity, such as camauba wax or candelilla wax, is used as the releasing agent, the amount of the wax exposed to the toner particle surface is inclined to be large. On the contrary, when a wax having a low polarity such as polyethylene wax or paraffin wax is used, the amount of the wax exposed to the toner particle surface is inclined to be small.

Irrespective of the amount of the wax inclined to be exposed to the toner particle surface, waxes having a melting point in the range of 30 to 150° C. are preferred and those having a melting point in the range of 40 to 140° C. are more preferred.

The wax is, for example, 0.1 to 10% by mass, and preferably 0.5 to 8% by mass, based on the toner.

The term "charge control" refers to a propensity of a toner addendum to modify the triboelectric charging properties of the resulting toner. A very wide variety of charge control agents for positive charging toners are available. A large, but lesser number of charge control agents for negative charging toners, is also available. Suitable charge control agents are disclosed, for example, in U.S. Pat. Nos. 3,893,935; 4,079,014; 4,323,634; 4,394,430 and British Patents 1,501,065; and 1,420,839. Charge control agents are generally employed in small quantities such as, from about 0.1 to about 5 weight percent based upon the weight of the toner. Additional charge control agents which are useful are described in U.S. Pat. Nos. 4,624,907; 4,814,250; 4,840,864; 4,834,920; 4,683,188 and 4,780,553. Mixtures of charge control agents can also be used.

The second step in the preferred process for formation of the porous particles employed in this invention involves forming a water-in-oil-in-water emulsion by dispersing the above mentioned first water-in-oil emulsion in a second aqueous phase containing either stabilizer polymers such as poylvinylpyrrolidone or polyvinylalchol or more preferably colloidal silica such as LUDOX™ or NALCOAG™ or latex particles in a modified ELC process such as described in U.S. Pat.

Nos. 4,833,060; 4,965,131; 2,934,530; 3,615,972; 2,932,629 and 4,314,932, the disclosures of which are hereby incorporated by reference.

Specifically, in the second step of the preferred process employed in the present invention, the water-in-oil emulsion is mixed with the second aqueous phase containing colloidal silica stabilizer to form an aqueous suspension of droplets that is subjected to shear or extensional mixing or similar flow processes, preferably through an orifice device to reduce the droplet size, yet above the particle size of the first water-in-oil emulsion and achieve narrow size distribution droplets through the limited coalescence process. The pH of the second aqueous phase is generally between 4 and 7 when using silica as the colloidal stabilizer.

The suspension droplets of the first water-in-oil emulsion in the second aqueous phase, results in droplets of binder polymer/resin dissolved in oil containing the first aqueous phase as finer droplets within the bigger binder polymer/resin droplets, which upon drying produces porous domains in the resultant particles of binder polymer/resin as shown in FIG. 1. The actual amount of silica used for stabilizing the droplets depends on the size of the final porous particle desired as with a typical limited coalescence process, which in turn depends on the volume and weight ratios of the various phases used for making the multiple emulsion.

Any type of mixing and shearing equipment may be used to perform the first step of preparing a water-in-oil emulsion, such as a batch mixer, planetary mixer, single or multiple screw extruder, dynamic or static mixer, colloid mill, high pressure homogenizer, sonicator, or a combination thereof. While any high shear type agitation device is applicable to this step, a preferred homogenizing device is the MICROFLUIDIZER such as Model No. 110T produced by Microfluidics Manufacturing. In this device, the droplets of the first water phase (discontinuous phase) are dispersed and reduced in size in the oil phase (continuous phase) in a high flow agitation zone and, upon exiting this zone, the particle size of the dispersed oil is reduced to uniform sized dispersed droplets in the continuous phase. The temperature of the process can be modified to achieve the optimum viscosity for emulsification of the droplets and to control evaporation of the solvent. For the second step, where the water-in-oil-in-water emulsion is formed, the shear or extensional mixing or flow process is preferably controlled in order to minimize disruption of the first emulsion. Droplet size reduction may be achieved by homogenizing the emulsion through a capillary orifice device, or other suitable flow geometry. The shear field used to create the droplets in the second emulsion may be created using standard shear geometries, such as an orifice plate or capillary. However, the flow field may also be generated using alternative geometries, such as packed beds of beads, or stacks or screens, which impart an additional extensional component to the flow. It is well known in the literature that membrane based emulsifiers can be used to generate multiple emulsions, the techniques here allow the droplet size to be tailored across a wider range of sizes by adjusting the void volume or mesh size, and may be applied across a wide range of flow rates. In the preferred method employed in this invention, the range of back pressure suitable for producing acceptable particle size and size distribution is between 100 and 5000 psi, more preferably between 500 and 3000 psi. The preferable flow rate is between 1000 and 6000 mL per minute.

The final size of the particle, the final size of the pores and the surface morphology of the particle may be impacted by the osmotic mismatch between the osmotic pressure of the inner water phase, the binder polymer/resin oil phase and the outer water phase. At each interface, the larger the osmotic pressure gradient present, the faster the diffusion rate where water will diffuse from the lower osmotic pressure phase to the higher osmotic pressure phase depending on the solubility and diffusion coefficient in the oil phase. If either the exterior water phase or the interior water phase has an osmotic pressure less than the oil phase then water will diffuse into and saturate the oil phase. For the preferred oil phase solvent of ethyl acetate this can result in approximately 8% by weight water dissolved in the oil phase. If the osmotic pressure of the exterior water phase is higher than the binder phase then the water will migrate out of the pores of the particle and reduce the porosity and particle size. In order to maximize porosity one preferably orders the osmotic pressures so that the osmotic pressure of the outer phase is lowest, while the osmotic pressure of the interior water phase is highest. Thus, the water will diffuse following the osmotic gradient from the external water phase into the oil phase and then into the internal water phase swelling the size of the pores and increasing the porosity and particle size.

If it is desirable to have small pores and maintain the initial small drop size formed in the step one emulsion then the osmotic pressure of both the interior and exterior water phase should be preferably matched, or have a small osmotic pressure gradient. It is also preferable that the osmotic pressure of the exterior and interior water phases be higher than the oil phase. When using weakly dissociating hydrocolloids such as CMC, one can change the pH of the exterior water phase using acid or a buffer preferably a pH 4 citrate buffer. The hydrogen and hydroxide ions diffuse rapidly into the interior water phase and equilibrate the pH with the exterior phase. The drop in pH of the interior water phase containing the CMC thus reduces the osmotic pressure of the CMC. By designing the equilibrated pH correctly one can control the hydrocolloid osmotic pressure and thus the final porosity, size of the pores and particle size.

A way to control the surface morphology as to whether there are open pores (surface craters) or closed pores (a surface shell) is by controlling the osmotic pressure of the two water phases. If the osmotic pressure of the interior water phase is sufficiently low relative to the exterior water phase the pores near the surface may burst to the surface and create an "open pore" surface morphology during drying in the third step of the process.

The third step in the preferred process for preparation of the porous particles employed in this invention involves removal of both the solvent that is used to dissolve the binder polymer and most of the first water phase so as to produce a suspension of uniform porous polymer particles in aqueous solution. The rate, temperature and pressure during drying will also impact the final particle size and surface morphology. Clearly the details of the importance of this process depend on the water solubility and boiling point of the organic phase relative to the temperature of drying process. Solvent removal apparatus such as a rotary evaporator or a flash evaporator may be used in the practice of the method of this invention. The polymer particles may then be isolated, after removing the solvent, by filtration, followed by drying in an oven at 40° C. which also removes any water remaining in the pores from the first water phase. Optionally, the particles are treated with alkali to remove the silica stabilizer.

Optionally, the third step in the preparation of porous particles described above may be preceded by the addition of additional water prior to removal of the solvent, isolation and drying.

Isolation of the porous particles, made by the multiple emulsion process, generally involves filtration of the particles, contact with base at pH>12, e.g., potassium hydroxide, to remove the colloidal silica stabilizer on the surface of the particles, followed by filtration to remove the external water phase and washing until the conductivity of the external water phase is less than 100 microSeimens/cm, preferably less than 10 microSeimens/cm. This is followed by another filtration to isolate the particles. Such filtrations have been discovered to be very slow due to the presence of water in the pores, as during filtration hydraulic pressure builds up in the filter cake, especially when the ionic strength in the external water phase is lower than in the pores. The problem is magnified during pressure filtration (e.g., wherein greater than atmospheric pressure is applied to the dispersion of porous particles during filtration) or vacuum filtration (e.g., wherein lower than atmospheric pressure is applied on a side of the filter opposite to the dispersion of porous particles during filtration), resulting in very slow filtration. The problem becomes especially evident when the ionic strength of the external water phase is low, e.g., when its specific conductivity is less than 100 microSeimens/em, and in particular less than about 10 microSeimens/cm and even less than about 3 microSeimens/cm. Conductivity measures the ability of a material to carry an electric charge through it. Since ions present in aqueous solution facilitate the conductance of electric current, the conductivity of the solution is proportional to its ionic strength. Low conductivity of the external water phase after repeated filtrations and washing of the particles causes water to rush back into the pores, creating hydraulic pressure build up in the pores and subsequently between the particles during filtration under pressure as is often practiced in manufacturing. In the practice of this invention, it has been discovered that such pressure build up between the particles can be minimized, and filtration rates improved, when the porous polymer particles are kept agitated during filtration, especially during pressure filtration, to keep the particles in motion and prevent clay-like structure formation which slows down dewatering or removal of water between the particles. Any type of agitation equipment may be used to agitate the dispersion of porous particles during filtration in accordance with the invention, e.g., magnetic stir bars, immersed propellers, ultrasonic vibrating devices, mechanical vibrating devices, etc.

The average particle diameter of the porous particles prepared in accordance with the present invention may be, for example, 2 to 200 micrometers, preferably 2 to 50 micrometers, and more preferably 3 to 20 micrometers. The porosity of the particles is greater than 10%, preferably between 20 and 90% and most preferably between 30 and 70%, where the percent porosity represents the volume of the internal pores as a percentage of the total volume of the particle. Percent porosity may be determined by the methods described in US 2008/0176164 and US 2008/0176157, the disclosures of which are incorporated by reference herein.

In other embodiments, in the process of the present invention, the dispersion of porous polymer particles in an external aqueous phase may be formed where a pore stabilizing hydrocolloid may be emulsified in an organic solution containing a mixture of water-immiscible polymerizable monomers, a polymerization initiator and optionally a colorant and a charge control agent to form the first water in oil emulsion. The resulting emulsion may then be dispersed in water containing stabilizer as described in the second step of the process to form a water-in-oil-in-water emulsion preferably through the limited coalescence process. The monomers in the emulsified mixture are polymerized in the third step to form droplets of polymer particles, preferably through the application of heat or radiation. Any remaining organic solution may be evaporated, and the resulting suspension polymerized particles may be isolated and dried as described earlier to yield porous particles. In addition, the mixture of water-immiscible polymerizable monomers can contain the binder polymers listed previously.

The shape of toner particles has a bearing on the electrostatic toner transfer and cleaning properties. Thus, for example, the transfer and cleaning efficiency of toner particles have been found to improve as the sphericity of the particles are reduced. A number of procedures to control the shape of toner particles are know in the art. In the practice of this invention, additives may be employed in the second water phase or in the oil phase if necessary. The additives may be added after or prior to forming the water-in-oil-in-water emulsion. In either case the interfacial tension is modified as the solvent is removed resulting in a reduction in sphericity of the particles. U.S. Pat. No. 5,283,151 describes the use of carnauba wax to achieve a reduction in sphericity of the particles. US Pat. Pub. 2008/0145779 describes the use of certain metal carbamates that are useful to control sphericity and US Pat. Pub. 2008/0145780 describes the use of specific salts to control sphericity. US Pat. Pub. 2007/0298346 describes the use of quaternary ammonium tetraphenylborate salts to control sphericity. The disclosures of these patents and applications are incorporated by reference herein.

Porous toner particles prepared in accordance with embodiments of the present invention may also contain flow aids in the form of surface treatments. Surface treatments are typically in the form of inorganic oxides or polymeric powders with typical particle sizes of 5 nm to 1000 nm. With respect to the surface treatment agent also known as a spacing agent, the amount of the agent on the toner particles is an amount sufficient to permit the toner particles to be stripped from the carrier particles in a two component system by the electrostatic forces associated with the charged image or by mechanical forces. Preferred amounts of the spacing agent are from about 0.05 to about 10 weight percent, and most preferably from about 0.1 to about 5 weight percent, based on the weight of the toner.

The spacing agent can be applied onto the surfaces of the toner particles by conventional surface treatment techniques such as, but not limited to, conventional powder mixing techniques, such as tumbling the toner particles in the presence of the spacing agent. Preferably, the spacing agent is distributed on the surface of the toner particles. The spacing agent is attached onto the surface of the toner particles and can be attached by electrostatic forces or physical means or both. With mixing, preferably uniform mixing is preferred and achieved by such mixers as a high energy Henschel-type mixer which is sufficient to keep the spacing agent from agglomerating or at least minimizes agglomeration. Furthermore, when the spacing agent is mixed with the toner particles in order to achieve distribution on the surface of the toner particles, the mixture can be sieved to remove any agglomerated spacing agent or agglomerated toner particles. Other means to separate agglomerated particles can also be used for purposes of the present invention.

The preferred spacing agent is silica, such as those commercially available from Degussa, like R-972, or from Wacker, like H2000. Other suitable spacing agents include, but are not limited to, other inorganic oxide particles, polymer particles and the like. Specific examples include, but are not limited to, titania, alumina, zirconia, and other metal oxides; and also polymer particles preferably less than 1 μm in diameter (more preferably about 0.1 μm), such as acrylic polymers, silicone-based polymers, styrenic polymers, fluoropolymers, copolymers thereof, and mixtures thereof The invention will further be illustrated by the following examples. They are not intended to be exhaustive of all possible variations of the invention.

The Kao Binder E, a polyester resin, used in the examples below was obtained from Kao Specialties Americas LLC a part of Kao Corporation, Japan. Carboxymethyl cellulose (CMC) molecular weight approximately 250K as the sodium salt was obtained from Acros Organics. The wax used in the preparation of P1 was the ester wax WE-3™ from NOF Corporation milled in ethyl acetate using Ceramer 1608™ and vinyl acetal polymer KS-10™, obtained from Sekisui Chemical Co. NALCOAG™ 1060, a colloidal silica, was obtained from Nalco Company as a 50 weight percent dispersion.

The particle size and distribution were characterized by a Coulter Particle Analyzer and Horiba Particle Size Analyzer. The volume median value from the Coulter measurements was used to represent the particle size of the particles described in these examples.

The extent of porosity of the particles of the present invention can be visualized using a range of microscopy techniques. Conventional Scanning Electron Microscope (SEM) imaging was used to image fractured samples and view the inner pore structure. The Scanning Electron Microscope (SEM) images give an indication of the porosity of the particles, but is not normally used for quantification. The level of porosity of the particles of the present invention was measured using a combination of methods. The outside or overall diameter of the particles is easily measured with a number of aforementioned particle measurement techniques, but determining the extent of particle porosity can be problematic. Determining particle porosity using typical gravitational methods can be problematic due to the size and distribution of pores in the particles and whether or not some pores break through to the particle surface. To accurately determine the extent of porosity in the particles of the present invention a combination of conventional diameter sizing and time-of-flight methods was used. The time-of-flight method used to determine the extent of porosity of the particles in the present invention includes the Aerosizer particle measuring system. The Aerosizer measures particle sizes by their time-of-flight in a controlled environment. This time of flight depends critically on the density of the material. If the material measured with the Aerosizer has a lower density due to porosity or a higher density due, for example, to the presence of fillers, then the calculated diameter distribution will be shifted artificially low or high respectively. Independent measurements of the true particle size distribution via alternate methods (e.g. Coulter) can then be used to fit the Aerosizer data with particle density as the adjustable parameter. The method of determining the extent of particle porosity of the particles of the present invention is as follows. The outside diameter particle size distribution is first measured using the Coulter particle measurement system. The mode of the volume diameter distribution is chosen as the value to match with the Aerosizer volume distribution. The same particle distribution is measured with the Aerosizer and the apparent density of the particles is adjusted until the mode (D50%) of the two distributions matches. The ratio of the calculated and solid particle densities is taken to be the extent of porosity of the particles. The porosity values generally have uncertainties of +/−10%.

The porous polymer particles were made using the following procedure:

Preparation of Porous Particles P1

CMC molecular weight 250K (8.5 grams) was dissolved in 168.5 grams of distilled water. This was dispersed in an oil phase containing 361 grains of a 24.9% KaoE binder stock solution, 63.7 grams of ethyl acetate, 70.7 grams of a 13.0% Pigment Blue 15:3 Millgrind and 80 grams of 11.5% WE-3 wax dispersion for two minutes at 6800 RPM using a Silverson L4R homogenizer fitted with the General-Purpose Disintegrating Head. The resultant water-in-oil emulsion was further homogenized using a Microfluidizer Model #100T from Microfluidics at a pressure of 8900 psi. A 750 g aliquot of the resultant very fine water-in-oil emulsion was dispersed, using the Silverson homogenizer again for two minutes at 2800 RPM, in 1185 grams of the second water phase comprising a pH 4 buffer and 64.5 grams of NALCOAG™ 1060, followed by homogenization in a orifice homogenizer at 1000 psi to form a water-in-oil-in-water double emulsion. The ethyl acetate was evaporated using a Buchi Rotovapor RE120 at 35° C. under reduced pressure to form a dispersion of porous polymer particles. The volume median particle size was 6 micrometers and the particles had a porosity of 38% afler isolation and drying.

Filtration Experiments:

An aliquot of the resulting suspension of particles were treated with 1N potassium hydroxide solution by adjusting to pH of 12.5 and held for 15 minutes to remove the colloidal silica on the surface of the beads. The slurry was then filtered and washed on a 80M glass fritted filter until the effluent had a conductivity of 4.8 micro Siemens/cm. This material was then used in the following filtration experiments designed to compare vacuum filtration using a glass fritted funnel to pressure filtration, with and without stirring. The pressure filtration experiments were done using a Millipore filtration cell (MFC), Model 8400 of 400 ml capacity, with polypropylene filter media of 3 micrometers cutoff and an attached magnetically stirred propeller.

Check 1—Pressure Filtration of P1 without Stirring:

In the first experiment a 4 gram damp cake from P1 was slurried in a beaker with 325 ml demineralized water then poured into the MFC, sealed and pressurized to 38 psi with nitrogen. The time for the water to come through the filter was 1810 seconds.

Example 1

Pressure Filtration of P1 with Stirring

In this experiment the effluent obtained from Check 1 was added back to the MFC containing the cake and stirred inside the cell using a magnetic stir plate for 30 seconds. The cell was then pressurized to 38 psi and the stirring was left on during filtration. The time for the water to come through was 453 seconds.

Check 2—Vacuum Filtration of P1 Using a Sintered Funnel:

The cake and effluent from Example 1 were recombined, slurried and then filtered without stirring using the 80M fritted funnel under 90 mm of vacuum. The time required for the water to come through was 3490 seconds.

TABLE 1

| Filtration Method | Filter time (seconds) | Difference |
|---|---|---|
| Example 1 | 453 | 1X |
| Check 1 | 1810 | 4X |
| Check 2 | 3490 | 7.7X |

As Table 1 shows, stirring the porous particles during dewatering greatly reduces the time required for filtering the particles.

Preparation of Solid Particles P2

An oil phase containing 241.6 grams of a 20.6% Kao E binder stock solution, and 8.4 grams of ethyl acetate was combined with a water phase comprising a pH 4 buffer and 25.9 grams of NALCOAG™ 1060, and homogenized using a Microfluidizer Model #110T from Microfluidics at a pressure of 8900 psi. The ethyl acetate was evaporated using a Buchi Rotovapor RE120 at 35° C. under reduced pressure to form solid (non-porous) polymer particles. A sample was analyzed using the Horiba particle size analyzer. The median size was 5.3 micrometers. This material was then used in the following filtration experiment as a comparison with the porous particles described below, for filtration efficiency.

Preparation of Porous Particles P3

CMC molecular weight 250K (1.5 grams) was dissolved in 75.4 grams of distilled water. This was dispersed in an oil phase containing 241.6 grams of a 20.6% Kao E binder stock solution, and 8.4 grams of ethyl acetate, for two minutes at 6800 RPM using a Silverson L4R homogenizer fitted with the General-Purpose Disintegrating Head. The resultant water-in-oil emulsion was further homogenized using a Microfluidizer Model #110T from Microfluidics at a pressure of 8900 psi. The resultant very fine water-in-oil emulsion was dispersed, using the Silverson homogenizer again for two minutes at 2800 RPM, in 396.17 grams of the second water phase comprising a pH 4 buffer and 25.9 grams of NALCOAG™ 1060, followed by homogenization in a orifice homogenizer at 1000 psi to form a water-in-oil-in-water double emulsion. The ethyl acetate was evaporated using a Buchi Rotovapor RE120 at 35° C. under reduced pressure to form porous polymer particles. A sample was analyzed using the Horiba particle size analyzer The median size was 5.7 micrometers. The particles had a porosity of 27%. This material was then used in the following filtration experiment.

Example 2

Pressure Filtration/No Stirring of P2 and P3

60 ml each of P2 and P3 slurries with approximately the same number of particles, were treated with 1N KOH to remove silica, filtered in the MFC under pressure, without stirring and washed several times with 200 mls of demineralized water each time until the conductivity was below 10 microSeimens/em. The results are shown in Table 2. It can be clearly concluded that the solid particles filter rapidly without stirring, while the porous particles filter much slower than the solid particles of similar size.

TABLE 2

| Particle ID | Filter time |
|---|---|
| P2 | 1 minute 5 seconds |
| P3 | 19 minutes 35 seconds |

Example 3

Pressure Filtration/Stirring vs. No Stirring of P3

60 ml each of P3 slurries with approximately the same number of particles were treated with 1N KOH to remove silica, filtered in the MFC under pressure, with and without stirring and washed several times with 200 mls of demineralized water, each time until the conductivity was less than 3 microSeimens/cm. The results are shown in Table 3. It can be seen from Table 3 that during filtration without stirring, as the ionic strength decreases to below 100 microSeimens, and in particular to below 3 microSeimens/cm, the filtration gets much slower, and that the porous particles filter relatively faster when stirring is used during filtration, particular when the ionic strength is less than 3 microSeimens/cm.

TABLE 3

| No Stirring | | Stirring | |
|---|---|---|---|
| Conductivity MicroSiemens/cm | Filter time Seconds | Conductivity MicroSiemens/cm | Filter time Seconds |
| 8000 | 10 | 8560 | 11 |
| 33 | 553 | 60.4 | 370 |
| 4 | 612 | 3.3 | 504 |
| 2.1 | 1438 | 2.6 | 646 |

The invention has been described in detail with particular reference to certain preferred embodiments thereof, but it will be understood that variations and modifications can be effected within the spirit and scope of the invention.

The invention claimed is:

1. A method of manufacturing porous polymer particles comprising:

forming a dispersion of washed porous polymer particles in an external aqueous phase, wherein individual porous particles each comprise a continuous polymer phase and internal pores containing an internal aqueous phase comprising a pore stabilizing hydrocolloid, the external aqueous phase of the dispersion of porous polymer particles has a specific conductivity of less than 100 microSeimens/cm and the ionic strength in the external aqueous phase is lower than the ionic strength in the internal aqueous phase, and the porous polymer particles have a porosity of greater than 10% based on volume of the internal pores as a percentage of the total volume of the particles; and filtering the dispersion of washed porous polymer particles with a filter to remove the external aqueous phase and isolate the porous polymer particles, wherein the filtering is done while agitating the porous particles.

2. The method of claim 1, wherein greater than atmospheric pressure is applied to the dispersion of porous polymer particles during filtration.

3. The method of claim 1, wherein lower than atmospheric pressure is applied on a side of the filter opposite to the dispersion of porous polymer particles during filtration.

4. The method of claim 1, wherein the external aqueous phase of the dispersion of porous polymer particles has a specific conductivity of less than 10 microSeimens/cm.

5. The method of claim 1, wherein the external aqueous phase of the dispersion of porous polymer particles has a specific conductivity of less than 3 microSeimens/cm.

6. The method of claim 1 further comprising drying the filtered porous polymer particles to remove the internal aqueous phase from the internal pores.

7. The method of claim 1, wherein the polymer comprises a polymer formed from vinyl monomers, condensation monomers, condensation esters, or mixtures thereof.

8. The method of claim 1, wherein the polymer is selected from the group consisting of polyesters, styrenes, vinyl ethers, and vinyl ketones.

9. The method of claim 1, wherein the polymer comprises a polyester.

10. A method according to claim 1, wherein the dispersion of porous polymer particles in an external aqueous phase is formed by the steps comprising:

providing a first emulsion of a first aqueous phase comprising a pore stabilizing hydrocolloid dispersed in an organic solution containing a polymer;

dispersing the first emulsion in a second aqueous phase to form a second emulsion;

shearing the second emulsion in the presence of a stabilizing agent to form droplets of the first emulsion in the second aqueous phase; and evaporating the organic solution from the droplets to form the aqueous dispersion of porous polymer particles.

11. The method of claim 10, wherein the hydrocolloid is selected from the group consisting of carboxymethyl cellulose (CMC), gelatin, alkali-treated gelatin, acid treated gelatin, gelatin derivatives, proteins, protein derivatives, synthetic polymeric binders, water soluble microgels, polystyrene sulphonate, poly(2-acrylamido-2-methylpropanesulfonate), and polyphosphates.

12. The method of claim 10, wherein the first aqueous phase further comprises buffering salts.

13. The method of claim 10, wherein the stabilizing agent comprises poylvinylpyrrolidone, polyvinylalchol, colloidal silica, or latex particles.

14. The method of claim 10, wherein the organic solution comprises ethyl acetate, propyl acetate, chloromethane, dichloromethane, vinyl chloride, trichloromethane, carbon tetrachloride, ethylene chloride, trichloroethane, toluene, xylene, cyclohexanone, or 2-nitropropane.

15. The method of claim 10, wherein the porous polymer particles comprise toner particles.

16. The method of claim 15, wherein the first emulsion further comprises a colorant.

17. The method of claim 15, wherein the first emulsion further comprises a colorant, a wax, and a charge control agent.

18. The method according to claim 1, wherein the dispersion of porous polymer particles in an external aqueous phase is formed by the steps comprising:

providing a first emulsion of a first aqueous phase comprising a pore stabilizing hydrocolloid dispersed in an organic solution containing water-immiscible polymerizable monomers and a polymerization initiator;

dispersing the first emulsion in a second aqueous phase to form a second emulsion;

shearing the second emulsion in the presence of a stabilizing agent to form droplets of the first emulsion in the second aqueous phase;

polymerizing the monomers to form droplets of polymer particles; and evaporating the organic solution from the droplets of polymer particles to form an aqueous dispersion of porous polymer particles.

19. The method according to claim 1, wherein the dispersion of porous polymer particles in an external aqueous phase is formed by the steps comprising:

providing a first emulsion of a first aqueous phase comprising a pore stabilizing hydrocolloid dispersed in a mixture of water-immiscible polymerizable monomers and a polymerization initiator;

dispersing the first emulsion in a second aqueous phase to form a second emulsion;

shearing the second emulsion in the presence of a stabilizing agent to form droplets of the first emulsion in the second aqueous phase; and polymerizing the monomers to form droplets of polymer particles to form an aqueous dispersion of porous polymer particles.

* * * * *